US011293145B2

(12) United States Patent
Buda et al.

(10) Patent No.: US 11,293,145 B2
(45) Date of Patent: Apr. 5, 2022

(54) GRIPPING MECHANISM FOR SPINDLE-SCREW CLIPPING MACHINE

(71) Applicant: SCHWIHAG AG, Tägerwilen (CH)

(72) Inventors: Roland Buda, Radolfzell am Bodensee (DE); Daniel Walter, Allensbach (DE); Thomas Dahmann, Aachen (DE); Markus Weigele, Langerwehe (DE)

(73) Assignee: SCHWIHAG AG, Tägerwilen (CH)

( * ) Notice: Subject to any disclaimer, the term of this patent is extended or adjusted under 35 U.S.C. 154(b) by 571 days.

(21) Appl. No.: 16/310,945

(22) PCT Filed: Sep. 19, 2017

(86) PCT No.: PCT/EP2017/073633
§ 371 (c)(1),
(2) Date: Dec. 18, 2018

(87) PCT Pub. No.: WO2018/050917
PCT Pub. Date: Mar. 22, 2018

(65) Prior Publication Data

US 2020/0308774 A1 Oct. 1, 2020

(30) Foreign Application Priority Data

Sep. 19, 2016 (DE) ..... 10 2016 217 885.7

(51) Int. Cl.
*E01B 29/24* (2006.01)
*E01B 35/02* (2006.01)
*E01B 29/28* (2006.01)

(52) U.S. Cl.
CPC ..... *E01B 29/24* (2013.01); *E01B 29/28* (2013.01); *E01B 35/02* (2013.01)

(58) Field of Classification Search
CPC ..... E01B 9/02; E01B 9/28; E01B 9/30; E01B 9/32; E01B 9/34; E01B 9/303; E01B 9/483; E01B 29/24; E01B 29/28
See application file for complete search history.

(56) References Cited

U.S. PATENT DOCUMENTS 3,690,264 A * 9/1972 Franz Plasser ..... B03C 1/16 104/17.1
4,068,593 A * 1/1978 Leeves ..... E01B 29/24 104/307
4,319,392 A * 3/1982 Cutts ..... E01B 29/24 29/402.08
4,320,707 A * 3/1982 McIlrath ..... E01B 29/24 104/17.2
8,322,686 B2 * 12/2012 Irion ..... E01B 29/24 254/18

(Continued)

FOREIGN PATENT DOCUMENTS

CN 1215228 C 8/2005
CN 202148474 U 2/2012

(Continued)

*Primary Examiner* — Zachary L Kuhfuss
(74) *Attorney, Agent, or Firm* — Smartpat PLC

(57) ABSTRACT

An installation device for tension clamps for attaching a rail to a railroad tie or another rail substructure, a method for attaching at least two tension clamps in their installation position by such an installation device, and a system made of an installation device with a drive device connected to it are disclosed.

20 Claims, 5 Drawing Sheets

(56) References Cited

U.S. PATENT DOCUMENTS

| | | | | |
|---|---|---|---|---|
| 8,499,695 | B1 | 8/2013 | Petkov | |
| 9,255,363 | B2 * | 2/2016 | Landstrom | E01B 29/14 |
| 2010/0187486 | A1 * | 7/2010 | Irion | E01B 29/24 254/1 |
| 2013/0055539 | A1 * | 3/2013 | Irion | E01B 29/24 29/244 |
| 2013/0239840 | A1 | 9/2013 | Landstrom et al. | |
| 2018/0347120 | A1 * | 12/2018 | Melvelle | E01B 29/29 |
| 2019/0003131 | A1 * | 1/2019 | Widlroither | B23P 19/06 |

FOREIGN PATENT DOCUMENTS

| | | | |
|---|---|---|---|
| CN | 204728154 | U | 10/2015 |
| CN | 205295824 | U | 6/2016 |
| DE | 1197108 | B | 7/1965 |
| EP | 0262701 | A1 | 4/1988 |
| EP | 1424444 | A2 | 6/2004 |
| EP | 1502993 | A3 | 4/2006 |
| EP | 2233639 | A2 | 9/2010 |
| JP | 2565702 | | 3/1998 |
| WO | 2012067575 | A1 | 5/2012 |
| WO | 2015170199 | A1 | 11/2015 |

* cited by examiner

GRIPPING MECHANISM FOR SPINDLE-SCREW CLIPPING MACHINE

TECHNICAL FIELD

The disclosure relates to the attachment of rails to their superstructure, usually railroad ties, by tension clamps.

BACKGROUND

Tension clamps are commonly used to provide a force-fitting link between a rail foot and a railroad tie, typically with the use of an angled guide plate and other suitable equipment. On each railroad tie, at least two tension clamps per rail are regularly used; they are assigned to each rail foot of a rail opposite to each other, i.e. four clamps per railroad tie.

When making and/or repairing a track system, a multitude of tension clamps must be installed and/or dismantled to ensure the secure hold of a rail and an entire track system on its base. Typically, the installation of such clamps, at least their insertion into their installation position, is done by hand.

As such, a task of invention was to automate as much as possible the process of the installation and dismantling of tension clamps, but at least not to have to carry out by hand the step of transferring a tension clamp from its pre-installation position to its installation position or back.

This task is accomplished by an installation device, a method, and a system as claimed.

SUMMARY

The disclosure provides an installation device capable of securely transferring tension clamps from a pre-installation position to an installation position abutting the rail foot of a rail. This preferably takes place via a wide range of clamp geometries, without the installation device having to be rebuilt separately or reequipped for this purpose. Advantageously, the manual work is thus kept to the necessary minimum, and the process of attaching the rail is essentially and preferably fully automated.

For this purpose, the installation device includes a gripping mechanism for the synchronous gripping of a tension clamp on each side of the rail foot and for applying a clamping force to the least two tension clamps, in order to securely hold the tension clamps and guide them into or out of their installation position. The gripping mechanism for this preferably includes two arms opposite each other, which, in a particularly advantageous configuration, are pre-tensioned in a manner movable towards each other by a tension spring or by a hydraulic two-way cylinder. In this context, it is particularly advantageous if the active surfaces opposite each other of the two gripping arms include an elastic support, preferably an elastomer support. On the one hand, this increases the friction coefficient of the active surface and, on the other hand, due to the elasticity of the support, it allows the gripping of various tension clamps and also provides an increased tolerance in the machine positioning.

In an equally preferred arrangement, gripper clips or snap closures can be arranged at the gripping arms; these grip and at least partially enclose the arms of the tension clamps that butt against the gripping arms of the gripping mechanism. This achieves an essentially positive-locking connection of the gripping mechanism with the tension clamps during the transport of the tension clamps from the pre-installation position to their installation position and back.

The gripping mechanism also includes a device capable of countering the tension force effected by the tension spring or a hydraulic two-way cylinder. This device is preferably a switchable and/or controllable hydraulic device by means of which the gripping arms of the gripping mechanism can be moved away from each other against the pulling force of the tension spring or by the hydraulic two-way cylinder in such a manner that the tension clamp is released by the gripping mechanism.

In an equally preferred arrangement, the gripping mechanism includes a lifting cylinder, preferably a double lifting cylinder, through which both the movement of the gripping arms of the gripping mechanism towards each other and away from each other can be realized. This means, that the gripping arms of the gripping mechanism are not pre-tensioned; rather, every movement of the gripping arms is only effected with appropriate control and actuation of the lifting cylinder.

In an additional advantageous embodiment, the installation device also includes a device for screwing in and screwing out at least two tension clamp screws. It is particularly advantageous if the device is capable of effecting the screwing in of the tension clamp screws with predetermined, defined torque. This particularly advantageously supports the automation of the rail assembly process on a suitable rail superstructure.

In this context, it is preferred if a device for the operative connection of gripping mechanism and device for screwing in and screwing out the tension clamp screws is provided, which synchronizes the movement of the gripping mechanism with the movement, effected upon the screwing in and screwing out of the tension clamp screw, of both the device for screwing in and screwing out and the tension clamps themselves.

An embodiment with which the installation device also includes a device to determine its position with respect to the rail, preferably to center the installation device in relation to the rail longitudinal axis, is also preferred.

In an additional preferred embodiment, the installation device includes two gripping mechanisms opposite each other, which are preferably arranged and movable in mirror image to each other. This results in the preferably simultaneous attachment of two tension clamps, one on each side of the rail foot. The movement of both gripping mechanisms can be synchronous; yet, optionally, a device with which the respective gripping mechanisms can be controllable and movable independent of each other will also be possible.

It is particularly preferred if the suspension and movement of the gripping mechanism is in the form of an eccentric swivel, with which a movement of the tension clamps from the pre-installation position into the installation position takes place in such a manner that the tension clamp is brought to a previously defined dimension of at least 15 mm, preferably at least 20 mm, more preferably at least 30 mm, above the angled guide plate into the area above the rail foot, in order then to be lowered from there onto the rail foot and the angled guide plate. With particularly simple and reliable means, this ensures that, during the movement of the tension clamp into its installation position, the tension clamp is not pushed against the rail foot even if the rail is not yet in an installed state, and lifts vertically from the railroad tie and the angled guide plate arranged on it. The gap between the railroad tie and the underside of the rail, if present, can be overcome securely through the forced guidance of the gripping mechanism specified by the eccentric swivel along with the tension clamps arranged in it.

It is also particularly preferred if the installation device is connected and/or connectable to a drive device that can be set on the rail and can be moved on it. In this connection, it is particularly preferred if the drive device is capable of driving the movements of all the mechanisms and devices of the installation device, including those that are hydraulic and electric or motorized/mechanical. This creates an essentially autonomous installation device along with a system made of an installation device and a drive device, by means of which the automated attachment of the tension clamps is particularly advantageously supported.

The invention achieves, or at least supports, that bending of the tension clamp does not occur. This is particularly supported if the tension clamp is gripped by spring force or hydraulic force and clamped in the gripping mechanism. A floating mounting of the gripping arms within the gripping mechanism enables the gripping of various tension clamps and, preferably together with elastomer layers on the active surfaces of the gripping arms, compensates for tolerances in the machine positioning.

Preferably, the transfer of the tension clamps from their installation position to their pre-installation position is done by lifting the tension clamp upon the unscrewing of the tension clamp screws. Thereby, the gap that is between the railroad tie and the rail is preferably bridged by the lifting movement if the tension clamp is raised sufficiently high.

Preferably, the transfer of the tension clamp from its pre-installation position to its installation position takes place via a swinging of the gripping mechanism by spring force, such that faulty tensioning of the machine in the event of unexpected collisions, for example in the presence of gravel between the tension clamp and rail, is avoided. In the case of an emergency stop of the machine, the mechanism does not cause faulty tension and can easily be loosened from the rail. In the case of a hydraulic sliding system, the hydraulics are automatically switched without pressure during an emergency stop.

A combined moving of the tension clamp with subsequent screwing after a pushing in of the tension clamp from the pre-installation position and a pushing out of the tension clamp into the installation position and securing it is particularly advantageous. This results in a rapid and easy use of the installation device along with the system made of an installation device and a drive unit at high speed and preferably synchronous screwing at a constant tightening torque. If an automatic search function is provided within the system and/or the installation device, the automation of the installation process is supported by the simple and preferably fully automatic insertion of the tension clamps in their installation position and the setting down of the device for screwing in and screwing out at least one tension clamp screw by simple and particularly effective means. This ultimately achieves a consistently high screwing accuracy, which prevents manual recalibration on the work site, in particular a manual reworking with a torque key.

According to another aspect, a method for attaching at least one tension clamp in its installation position is made available by an installation device according to the first aspect. The main steps of the method are (i) the setting down and preferably centering of the installation device on the rail, (ii) the gripping and clamping of the tension clamp by the gripping mechanism in a pre-installation position, (iii) the moving of the gripping mechanism and tension clamp into the installation position, (iv) the loosening of the clamping force of the gripping mechanism and the releasing of the tension clamp and (v) the removal of the gripping mechanism from the installation position without a tension clamp.

It is preferred if the method also includes the step of the screwing in at least one tension clamp screw, preferably with defined torque, after step (iii) or step (iv) or step (v).

It is particularly preferred if the device for screwing in and screwing out follows the movement of the tension clamp screw in its longitudinal direction during the screwing process. This provides a method that particularly advantageously supports the automation of the attachment process and reliably prevents individual device and mechanism parts from jamming with each other.

In order to attach the rail to the railroad tie or other rail substructure, the following work steps are provided for in a preferential embodiment of the method:

1. The machine operator sets the screw head on the screw.
2. The cylinder of the gripping mechanism is switched without pressure and the gripping arms of the gripping mechanism clamp the tension clamp in a defined manner by spring force or hydraulic force. The preferably existing rubber support on the gripping arms of the gripping mechanism is slightly deformed, such that the tension clamp gets a firm hold. This results in a combination of force closure and form closure.
3. The tension clamp screws are loosened by a defined number of rotations. Thereby, the entire mechanism is moved upwards over the screw heads according to the thread pitch and spindle rotations. The large-to-high lifting of the tension clamp that is thereby effected makes it possible to engage it despite a larger gap between the railroad tie and the rail, without it bouncing against the rail foot.
4. Disengaging cylinders provided in the installation device for effecting the movement of at least the gripper arms of the gripping mechanism from the pre-installation position into the installation position or back are switched without pressure, and the gripping mechanism together with the clamped tension clamp is preferably engaged in the installation position by spring force or hydraulic force. The movement stroke is preferably limited by a stop provided at the installation device.
5. The tension clamp screw is tightened in a torque-controlled manner and the mechanism is lowered downwards according to the thread pitch and the spindle rotations over the tension clamp screw heads. The tension clamp is then in the installation position provided for this purpose.
6. Pressure is placed on a cylinder of the gripping mechanism, such that the gripping arms of the gripping mechanism break apart and release the tension clamps.
7. Pressure is placed on the disengaging cylinder of the installation device, such that the gripping mechanism is driven into its initial position, thus the pre-installation position.
8. The machine operator or the automatic mechanism then switches to the next pair of screws.

In accordance with this procedure, the processes for disengaging the tension clamp from the installation position to the pre-installation position are carried out in reverse order.

According to a third aspect, a system is provided on the installation device in accordance with the first aspect along with a drive device connected to the installation device. Preferably, the drive device includes suitable means of setting down the drive device on a rail and for moving the drive device together with the installation device along the rail longitudinal axis. More preferably, the drive device includes at least one engine in particular, through which both the movement of the system as a whole along the rail and the movement of the individual gripping mechanisms and screw directions can be effected. The same applies to the provision of the hydraulic pressure required for movements of the installation device or individual components.

DETAILED DESCRIPTION

Figure 1:
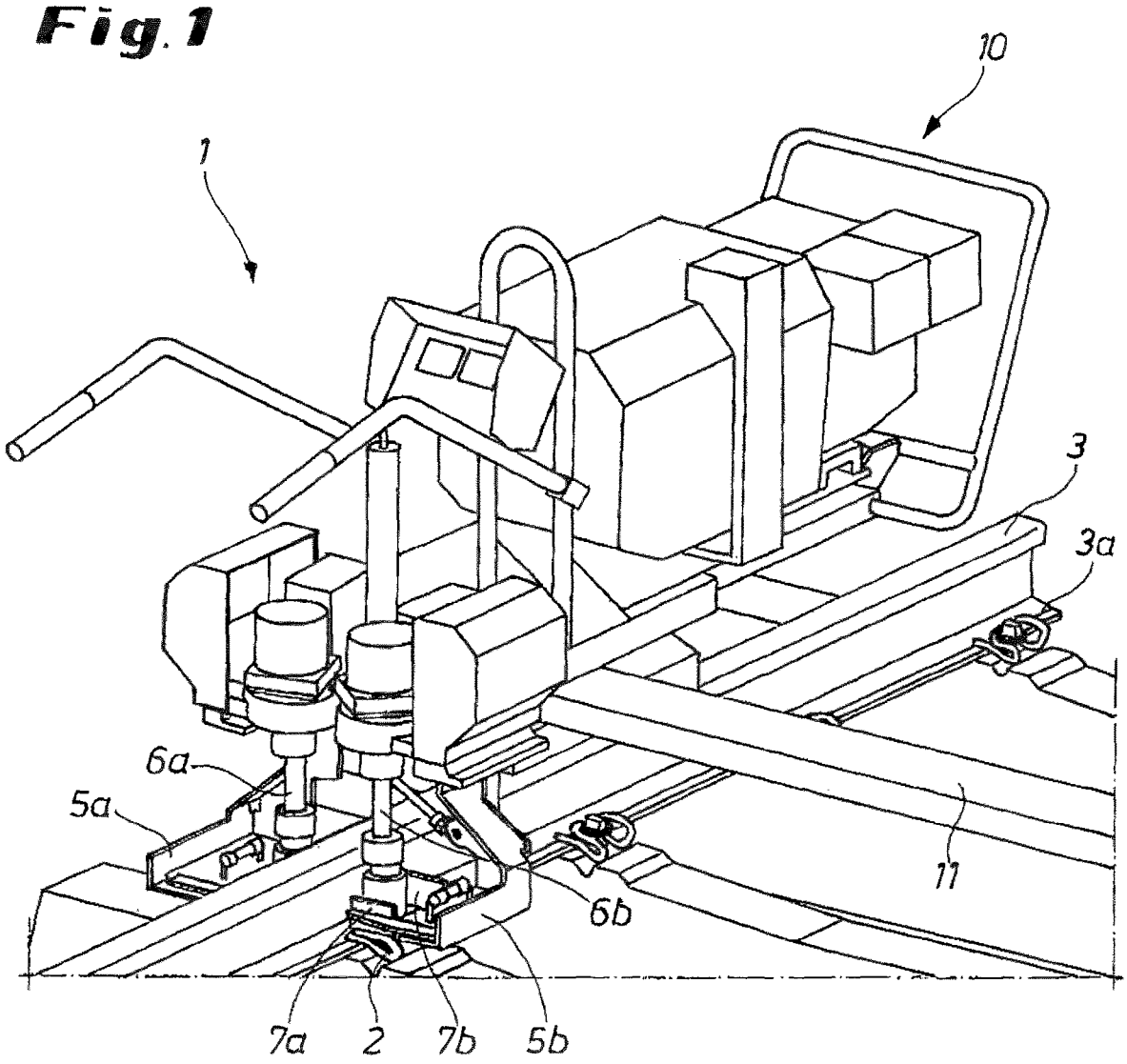
FIG. 1 shows a top view of a system, including an installation device and a drive device.

FIG. 1 shows a system, including an installation device 1 and a drive device 10 connected thereto. The system is set down on a rail 3 and is supported by a cross-connector 11, which is connected to the drive device 10, on the rail running in parallel (not shown), and is guided in the longitudinal direction of the rail 3. The installation device 1 includes two gripping mechanisms 5 opposite each other, each of which leads tension clamps 2 between two gripping arms 7*a*, 7*b* into their installation positions. In the installation position, the tension clamps 2 are arranged in such a manner that they are arranged both on the rail foot 3*a* and on an angled guide plate that is set down on a railway tie. Two screw devices 6*a*, 6*b* securely screw the tension clamp 2 in their depicted installation position.

Figure 2A:
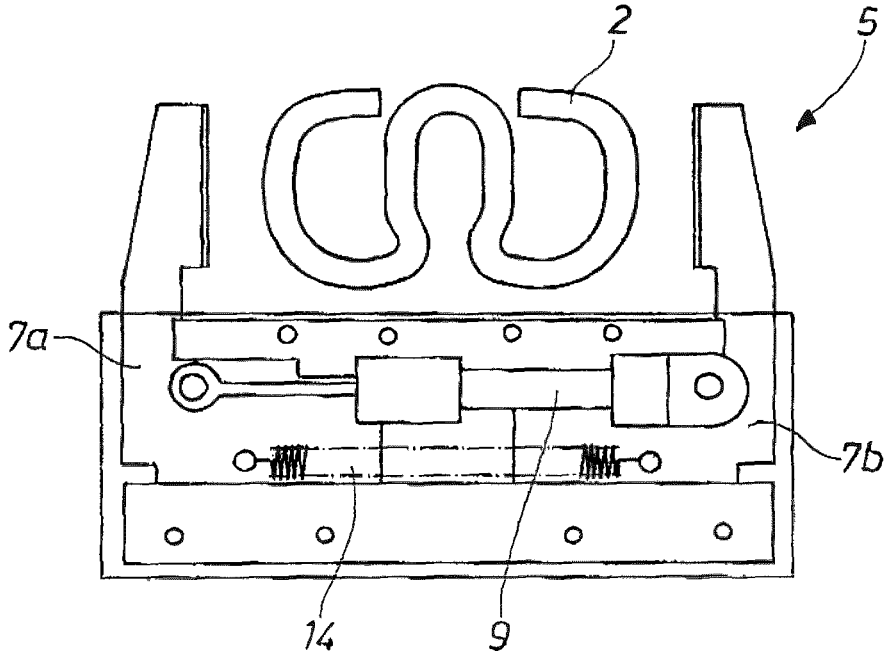
FIG. 2 shows a gripping mechanism of an installation device, both in a loose position (FIG. 2*a*) and in an engaged position (FIG. 2*b*).

FIG. 2*a* shows a gripping mechanism 5 of the installation device 1 in a loose state, in which two gripping arms 7*a*, 7*b* opposite each other, which are tensioned towards each other by a tension spring 14 or a two-way cylinder (not shown), are moved away from each other by a hydraulic cylinder 9 in order to release the tension clamps 2.

Figure 2B:
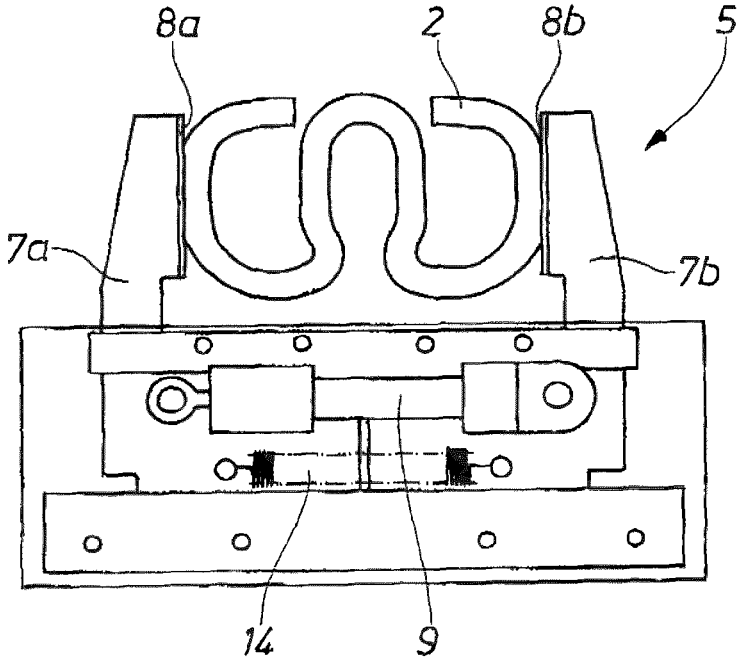

FIG. 2*b* shows the gripping mechanism from FIG. 2*a* in its clamping position, in which the rubberized supports 8*a*, 8*b* on the active surfaces of the gripping arms 7*a*, 7*b* of the gripping mechanism 5 clamp the tension clamps 2 in a manner that is force-fitting and at least partially positive-locking. The hydraulic cylinder 9 is in an unswitched position, such that the gripping arms 7*a*, 7*b* of the gripping mechanism 5 are moved towards each other by the tension spring effect or the hydraulic force effect in such a manner that the tension spring 14 is kept securely between the gripping arms 7*a*, 7*b*.

Figure 3:
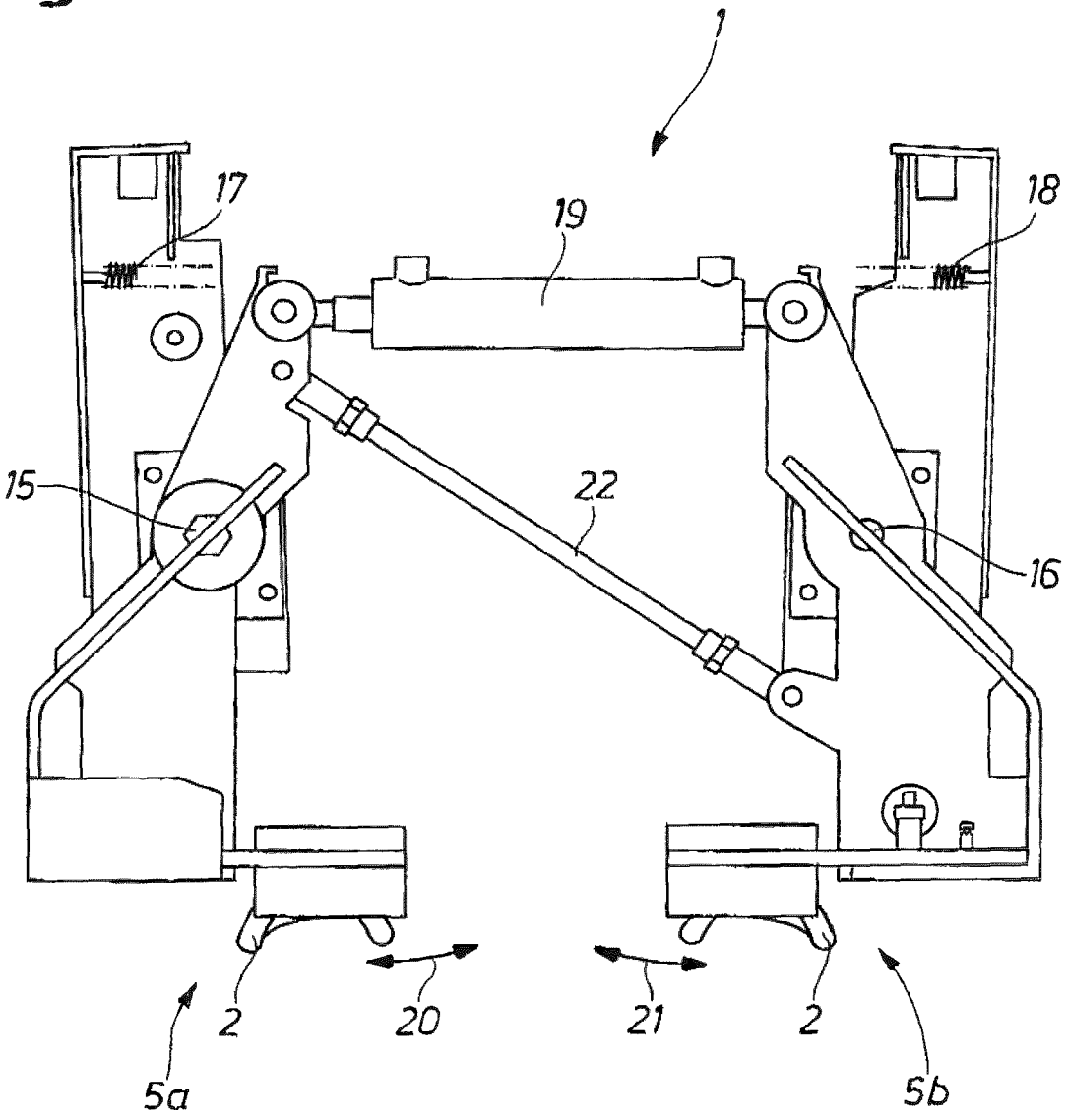
FIG. 3 shows a top view of parts of an installation device.

FIG. 3 shows a top view of a part of the installation device 1 with two gripping mechanisms 5*a*, 5*b* arranged opposite each other. The respective gripping mechanisms 5*a*, 5*b* are arranged rotatably around respective pivot bearings 15, 16 and are pre-stressed by respective tension springs 17, 18 or hydraulics in such a manner that, without the actuation of the disengaging cylinder arranged between the gripping mechanisms 5*a*, 5*b* opposite each other, a pivoting of the tension clamp 2 arranged between the respective gripping arms of the gripping mechanisms 5*a*, 5*b* is effected in a pivoting movement along the arrows 20, 21 (shown). A synchronization of the movement of the respective gripping mechanisms 5*a*, 5*b* can be effected by the coupling rod 22 arranged between the two gripping mechanisms 5*a*, 5*b*.

Figure 4B:
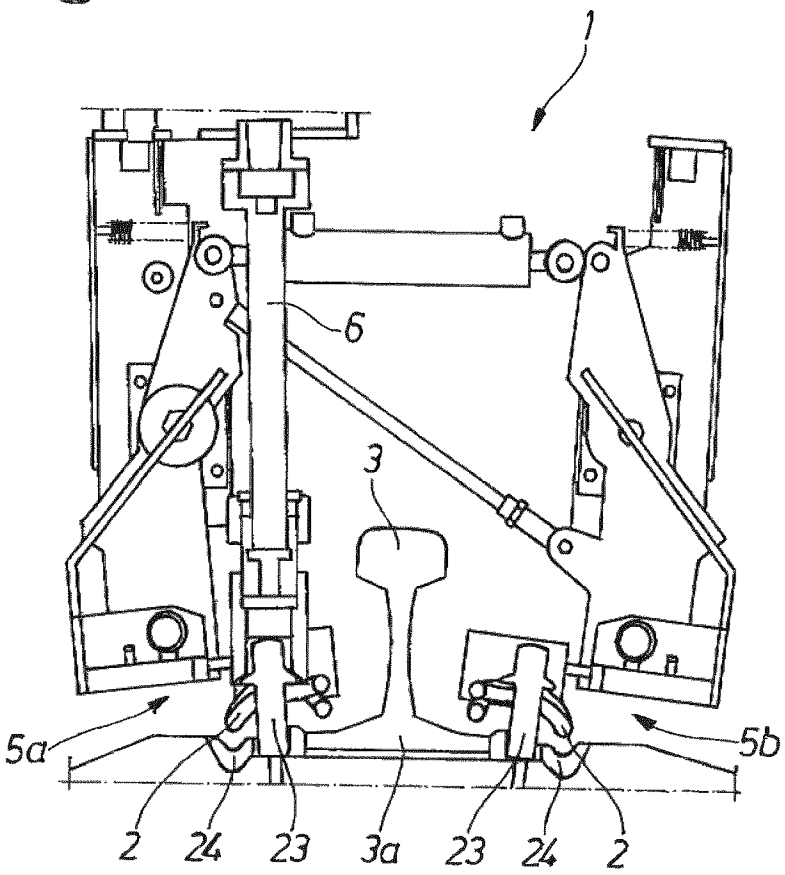
FIG. 4 shows the installation device according to FIG. 3 in both a gripping position (FIG. 4*a*) and a slid-in position (FIG. 4*b*).
Figure 4A:
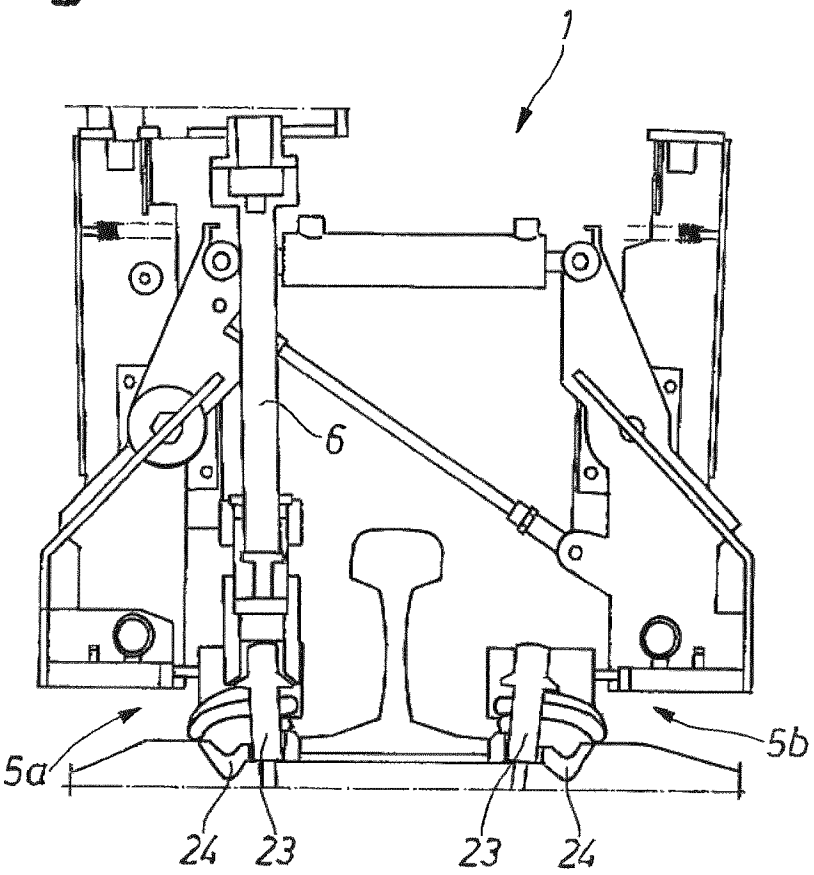

FIG. 4*a* shows part of an installation device 1 with two gripping mechanisms 5*a*, 5*b* arranged opposite each other in a gripping position, with which the tension clamp screws 23 are screwed out of the angled guide plates 24 to a specified extent by the device 6 for screwing in and screwing out the tension clamp screws 23, in order to enable the tension clamps 2 to be pushed into their installation position by the gripping mechanisms 5*a*, 5*b*.

FIG. 4*b* shows parts of the installation device 1 according to FIG. 4*a* in an insertion position, with which, after the loosening of the disengaging cylinder 19, the gripping mechanisms 5*a*, 5*b* were swiveled into their installation position by the action of the tension springs 2 on the rail 3. The respective tension clamps 2 are now arranged both above the rail foot 3*a* and above the angled guide plate 24 in such a manner that the installation of the tension clamps 2 can be easily effected automatically by screwing in the tension clamp screws 23 by the device 6 for screwing in and screwing out the tension clamp screws 23.

Figure 5B:
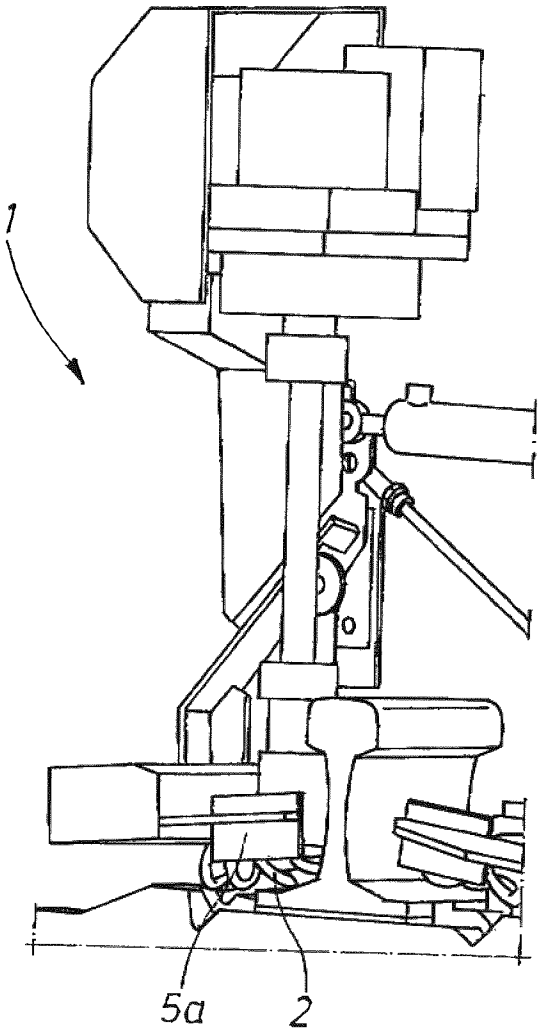
FIG. 5 shows part of an installation device while attaching the tension clamps in their installation position.
Figure 5A:
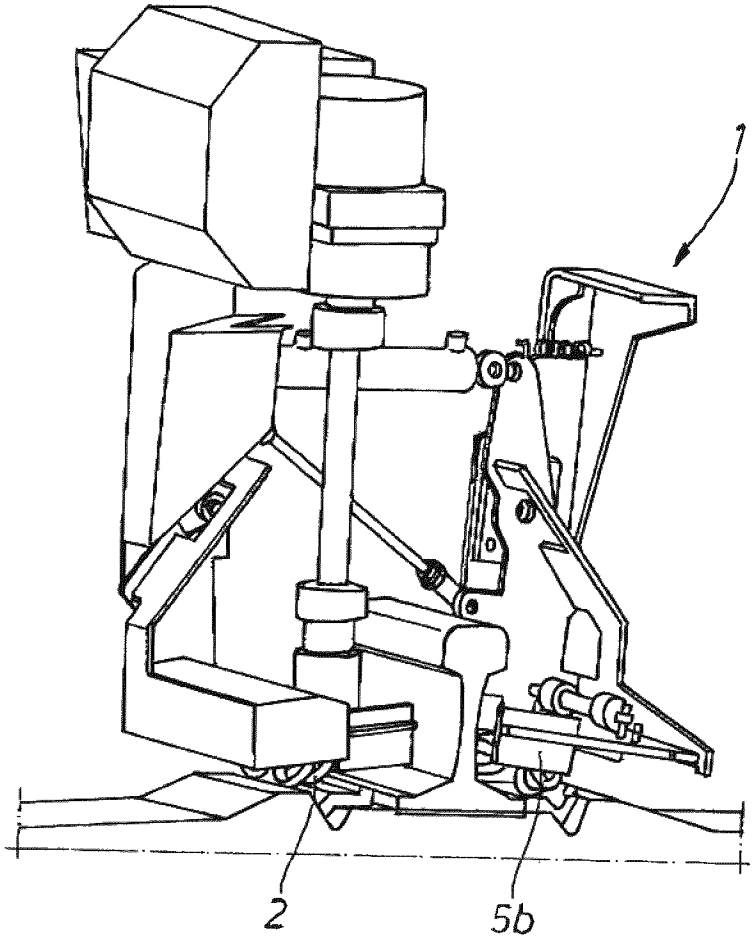

FIGS. 5*a* and 5*b* show a top view of parts of an installation device 1 with gripping mechanisms 5*a*, 5*b*, swiveled into the installation position, for the tension clamps 2.

The invention claimed is:

1. An installation device for tension clamps for attaching a rail on a railroad tie or other rail superstructure, comprising:

a first gripping mechanism and a second gripping mechanism for synchronous gripping two tension clamps and for synchronous moving the two tension clamps from a pre-installation position to an installation position; and a device for synchronous screwing in and screwing out of two tension clamp screws, wherein the first gripping mechanism and the second gripping mechanism each comprise two gripping arms that are longitudinally spaced from one another and extend perpendicular to a longitudinal axis of the rail.

2. The installation device according to claim 1, further comprising a device for operative connection of the gripping mechanisms and the device for synchronous screwing in and screwing out which can synchronize movement of the gripping mechanisms during synchronous screwing in and screwing out of the two tension clamp screws with the device for screwing in and screwing out.

3. The installation device according to claim 1, further comprising a device to determine a position of the installation device on the rail.

4. The installation device according to claim 1, further comprising a coupling rod arranged between the first gripping mechanism and the second gripping mechanism which causes the first gripping mechanism and a second gripping mechanism to move in mirror image to each other.

5. The installation device according to claim 1, wherein the two gripping arms of each of the gripping mechanisms can move longitudinally towards each other and away from each other for gripping the two tension clamps.

6. The installation device according to claim 5, wherein active surfaces opposite of each other of the two gripping arms include elastic supports.

7. The installation device according to claim 6, wherein the elastic supports are elastomer supports or gripping closures.

8. The installation device according to claim 1, wherein the gripping mechanisms can be transferred from a loosened position into a gripping position by spring force or hydraulic force.

9. The installation device according to claim 1, wherein the gripping mechanisms can be transferred from a gripping position into a loosened position using a switchable and/or controllable hydraulic device.

10. The installation device according to claim 1, wherein the gripping mechanisms are transferred from a loosened position into a gripping position and back by a lifting cylinder.

11. The installation device according to claim 1, wherein the installation device is connected to and/or connectable to a movable drive device.

12. The installation device according to claim 11, wherein movements of all mechanisms and devices, including those that are hydraulic and electric or motorized-mechanical, can be driven through the movable drive device.

13. The installation device according to claim 1, wherein synchronous attachment and/or synchronous removal of at least two tension clamps can be effected automatically.

14. A system, comprising the installation device according to claim 1 and a drive device connected to the installation device.

15. The system according to claim 14, wherein the drive device comprises means of setting down and moving the system on a rail.

16. The system according to claim 14, wherein the drive device comprises a device for automatic search function.

17. The installation device according to claim 1, further comprising a coupling rod arranged between the first gripping mechanism and the second gripping mechanism, wherein the gripping mechanisms are arranged rotatably around respective pivot bearings to pivot laterally relative to the rail, wherein the lateral pivoting motion of the gripping mechanisms is effected by a disengaging cylinder arranged above the rail and above the respective pivot bearings, and wherein the coupling rod is connected to the first gripping mechanism above the respective pivot bearing and connected to the second gripping mechanism below the respective pivot bearing.

18. The installation device according to claim 1, wherein the two gripping arms of each the first gripping mechanism and a second gripping mechanism are pulled towards each other by a tension spring and moved away front each other by a hydraulic cylinder while maintaining a parallel orientation.

19. A method for attaching two tension clamps, comprising:

providing an installation device for tension clamps for attaching a rail on a railroad tie or other rail superstructure, comprising a first gripping mechanism and a second gripping mechanism for synchronous gripping two tension clamps and for synchronous moving the two tension clamps from a pre-installation position to an installation position, wherein the first gripping mechanism and the second gripping mechanism each comprise two gripping arms that are longitudinally spaced from one another and extend perpendicular to a longitudinal axis of the rail;

setting down the installation device on the rail;

gripping and clamping the two tension clamps by the gripping mechanism in the pre-installation position;

moving the gripping mechanisms and the two tension clamps into the installation position;

tightening tension clamp screws by applying a defined torque or by positive-locking application at least parts of the two tension clamps on angled guide plates;

loosening of the clamping force of the gripping mechanism and releasing the tension clamps; and removing the gripping mechanism from the installation position without the two tension clamps.

20. The method according to claim 19, wherein tightening tension clamp screws by applying a defined torque is performed by a device for screwing in and screwing out which follows a movement of the tension clamp screws in their longitudinal direction during the screwing process.

* * * * *